United States Patent [19]

Sriramamurty et al.

[11] 4,056,043

[45] Nov. 1, 1977

[54] FLUID POWER PISTON ACTUATORS

[75] Inventors: Durvasula V. Sriramamurty, Milwaukee; Donald E. Brzezinski, Brookfield, both of Wis.

[73] Assignee: Johnson Controls, Inc., Milwaukee, Wis.

[21] Appl. No.: 625,823

[22] Filed: Oct. 28, 1975

[51] Int. Cl.[2] ..... F15B 15/24

[52] U.S. Cl. ..... 92/13.2; 92/13.41; 92/13.6; 92/98 D; 92/99; 92/118; 403/131

[58] Field of Search ..... 92/13.2, 13.41, 13.6, 92/99, 98 D, 118, 119, 161; 403/131, 122

[56] References Cited

U.S. PATENT DOCUMENTS

| | | | |
|---|---|---|---|
| 1,183,486 | 5/1916 | Pardue | 92/13.2 |
| 2,948,221 | 8/1960 | Carver | 92/13.2 X |
| 3,311,030 | 3/1967 | Halstead | 92/167 X |
| 3,408,899 | 11/1968 | Golden | 92/99 X |
| 3,635,127 | 1/1972 | Wagstoff | 92/161 |
| 3,730,369 | 5/1973 | Keene | 403/131 X |
| 3,744,381 | 7/1973 | Travaglio | 92/161 |
| 3,762,280 | 10/1973 | Kreuter et al. | 92/98 D |

*Primary Examiner*—Irwin C. Cohen
*Attorney, Agent, or Firm*—Andrus, Sceales, Starke & Sawall

[57] ABSTRACT

A pneumatic actuator includes a cup-shape cylinder body housing a piston and having a generally flat base with a mounting hub projecting outwardly. A piston rod is slidably mounted in the hub and connects to a load such as a damper in an air mixing box. The base is formed with a bearing recess or depression means encircling the hub. The recess defines a spherical sector offset from the center of a complete sphere of the same radius. An annular swivel ring includes an inner diameter adapted to loosely fit over the hub and includes an outer periphery which is generally spherically shaped and defines a central spherical sector having a maximum planar diameter slightly larger than that of the sector defined by recess. The swivel ring is a two-part member having interconnecting slot and projection elements providing a snap joint connection, with the mounting plate firmly clamped therebetween. The swivel ring with the attachment plate fits over the mounting hub. A clamping nut means is secured to the hub with a bearing recess generally corresponding to that formed in the base. An outer head is secured to the cylinder by a suitable snap joint with a peripherial head of a diaphragm rigidly clamped therebetween. A cup-shaped piston is connected to a piston rod by a snap joint which permits free rotation of the rod within the piston. The piston opens into the cylinder and provides a guide for a clamp spring which acts between the piston and the base of the cylinder. The diaphragm ovelies the face of the piston and extends downwardly therebetween to develop a rolling diaphragm construction.

18 Claims, 7 Drawing Figures

FLUID POWER PISTON ACTUATORS

BACKGROUND OF THE INVENTION

This invention relates to a fluid power actuator and particularly to such an actuator having an integrated mounting means.

Fluid actuators of the piston type are employed to provide reliable, low cost controls particularly where substantial loads and a compact construction are required. Pneumatic operators are widely employed because of the simplification permitted by the use of air and the readily available air sources in commercial, industrial and like applications. In particular, in environmental control systems and the like, pneumatic actuators are employed for positioning of various controls. A heating, ventilating and air conditioning system for example normally includes dampers for proper directing of the air throughout the system. In such systems, the room air may be recirculated through the system and selectively mixed with selected amounts of fresh air in a suitable mixer box. Dampers are employed to control the relative proportions of the recirculated air and fresh air. Within the system, the treated air is routed through different ducts to the various areas, with the amount and direction also controlled by suitable dampers. Pneumatic damper actuators are conveniently employed to establish a proportional and/or on-off setting of the dampers in response to various sensed conditions. In any given institutional or commercial installation, a substantial number of individually controlled dampers might be employed to provide optimum air flow.

A satisfactory actuator found in the prior art employes a piston-cylinder and diaphragm construction. Generally, a diaphragm has its periphery secured to the wall of a cylinder unit and secured to the face of a piston. The diaphragm defines a signal chamber connected to a suitable air pressure signal source to receive a suitable pressure signal from a controller. The piston-diaphragm are spring-loaded to an initial position with a minimum input signal and provide a working stroke over a selected pressure signal range. The actuator will generally be provided with a mounting bracket for mounting of the actuator to the damper assembly with the piston rod interconnected to the damper control or to the damper element through a suitable linkage. Generally, in a variable volume damper of a high velocity mixing box for an air conditioning system, a system pressure range of 15 to 25 PSI may be available but is more typically 15 to 20 PSI. The actuator spring-loading is typically designed to cover spring ranges of 5–10, 8–13, and 10–15 pounds per square inch (PSI).

For purposes of economy and practical implementation, the prior art has developed low cost, expendable or throw-away actuators for convenient original installation and maintenance of relatively large system. Generally, such prior art devices have employed a molded plastic construction of the cylinder unit and piston. The cylinder is generally a cup-shaped member with a separate head secured to the open end. A piston is located in the cylinder unit with a piston shaft projecting through the one end of the cylinder and with a spring biasing the piston to retract the piston rod. A diaphragm is secured to the face of the piston with the periphery of the diaphragm clamped between the cylinder head and the cylinder to define the signal input chamber to the side of the diaphragm opposite the piston. The control signal applied to the input chamber forces the piston and piston rod to move and compress the spring in accordance with pressure level. The construction is preferably such as to provide a linear output movement, with the pressure signal for corresponding positioning of the dampers or other load.

The several components of the throw-away type plastic actuators should be uniquely adapted to mass production while permitting a construction having a high degree of reliability and reasonable life. Actuator manufacturers often supply various original equipment manufacturers of different systems to obtain the maximum benefits of mass production. The actuator must, however, be compatible with the widely varying specification as to size, mounting and interconnection to the particular load.

Although such unit is available, it generally is provided with special mounting members for adaptation to various mounting specifications. The working stroke may also be different in different loads and applications. Generally, a preset stroke with an adjustable linkage or suitable adjustment screw stops may be provided to adapt the actuator to different stroke requirements.

In summary, although satisfactory relatively inexpensive plastic actuators have been designed, there is a need for a highly versatile reliable actuator which can be directly adapted in a convenient and inexpensive manner to the widely varying specifications encountered in the field and in the industrial arts, particularly in the heating, ventilating and air conditioning damper control applications.

SUMMARY OF THE INVENTION

The present invention is particularly directed to a fluid actuator having a novel, versatile integral mounting means permitting convenient attachment to a load and is uniquely adapted to construction as a low-cost, throw-away type pneumatic actuator. Generally, in accordance with the present invention, the actuator includes a mounting means which is adapted to interconnect to a mounting surface with either a swivel or rigid mounting of the actuator directly. In accordance with this aspect of the invention, the actuator includes a mounting hub through which a linear operator projects. The mounting surface is located on the hub and is secured in position by a suitable clamping member secured to the hub. The clamping member may be constructed to directly clamp the flat mounting surface to the actuator for rigid face mounting. Alternatively, the hub is constructed to receive a swivel support means which is secured to the mounting surface and the assembly clamped to the actuator to provide a swivel mount of the actuator.

In a particularly novel aspect of the present invention, the actuator includes a cylinder body having a generally flat base with the mounting hub projecting outwardly. The base is formed with a bearing recess or depression means encircling the hub and which is generally spherically shaped and defines a spherical sector offset from the center of a complete sphere of the same radius. An annular swivel member includes an inner diameter adapted to loosely fit over the hub and includes an outer periphery which is generally sperically shaped and defining a central spherical sector having a maximum planar diameter slightly larger than that of the sector defined by recess. The swivel member with the attachment surfaces telescopes or slides over the mounting hub with the inner end projecting inwardly into the bearing recess and supporting the surface in slightly outwardly spaced relation with the base of the cylinder element. A clamping means is secured to the hub with a bearing recess generally corresponding to that formed in the base and telescoped over the outer portion of the swivel member and firmly supporting the swivel member clamped against and into the base bearing recess. The mating spherical surfaces permit slight swivel movement of the actuator with respect to the mounting surface, and thus permits desired swivel mounting of the actuator where required.

The swivel adaptor member preferably is formed as a two-part member having interconnecting slot and projection elements providing a snap joint connection, with the mounting surface firmly clamped therebetween. Thus, when the adaptor is clamped in position, it further collapses to firmly hold the mounting surface to the adaptor for the desired swivel motion.

In accordance with a particularly unique embodiment of the present invention, the actuator is formed with a cup-shaped cylinder in combination with an outer cap or head, which is secured to the cylinder by a suitable snap joint. A diaphragm includes a peripherial bead which is rigidly clamped between the end of the cylinder and an opposed abutting clamping ledge on the head. The piston is a cup-shaped member connected to the piston rod by a snap joint which permits free rotation of the rod within the piston. The piston opens into the cylinder and provides a guide for a clamp spring which acts between the piston and the base of the cylinder. The diaphragm overlies the face of the piston and extends downwardly therebetween to develop a rolling diaphragm construction.

In accordance with a further particular aspect of the present invention, snap-in stroke adjustment members are releasably secured to the side wall of this cylinder. The stops are adjustably positioned in the side wall to limit the travel of the piston and thereby control the operating stroke of the actuator.

The present invention thus provides an approved mounting assembly while maintaining further economy of construction such as to particularly adapt the present invention to the construction of an inexpensive damper actuator.

BRIEF DESCRIPTION OF THE DRAWINGS

The drawings furnished herewith illustrate the best mode presently contemplated by the inventors for carrying out the subject invention, and clearly discloses the above advantages and features as well as others which will be readily understood from the subsequent description of the illustrated embodiments.

In the drawings.

DESCRIPTION OF ILLUSTRATED EMBODIMENT

Figure 1:
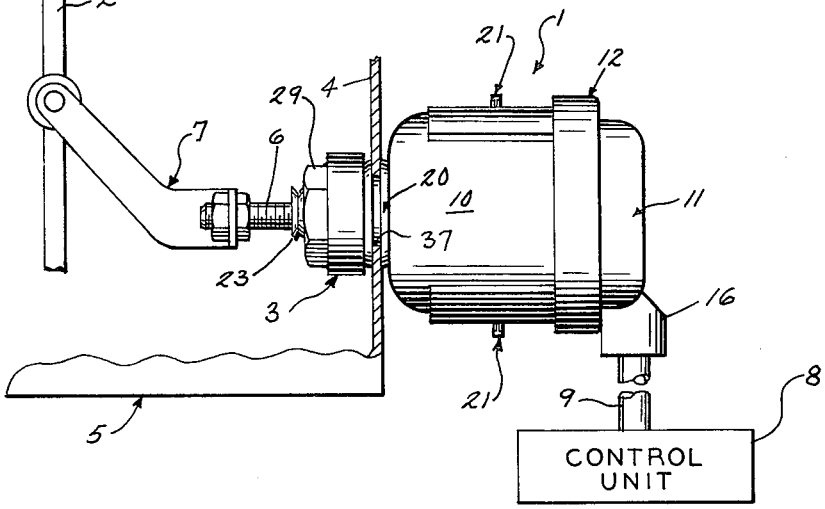
FIG. 1 is a pictorial view of a piston actuator constructed in accordance with the present invention.

Referring to the drawings and particularly to FIG. 1, a piston actuator 1, constructed in accordance with a preferred embodiment of the present invention, is illustrated for positioning of a damper 2 as a typical load. The actuator 1 is a fluid powered unit and in a preferred construction is a pneumatic unit as more fully described hereinafter. A novel swivel mounting means 3 is uniquely integrated with the actuator 1 and interconnected to a support wall 4 of a damper housing 5 in the illustrated embodiment of the invention. The piston actuator 1 includes a piston rod 6 projecting outwardly from one end of the actuator 1 and interconnected by a suitable linkage 7 for positioning of the damper 2. A control unit 8 of any suitable construction is provided to generate an appropriate pneumatic signal to actuator 1. For example, the damper 2 may be set to selectively control the mixing of fresh and return air of a suitable environmental air conditioning system such as shown in U.S. Pat. No. 3,913,344. In that patent, a fluidic system controls the percentage of return and fresh air introduced into environmental cooling system. The fluidic system generates a pneumatic signal suitable for operating of a pneumatic actuator such as actuator 1. A signal line 9 to the actuator 1 establishes a pneumatic pressure signal for operating the actuator and positioning of the air damper 2 in accordance with the environmental air conditions.

Figure 2:
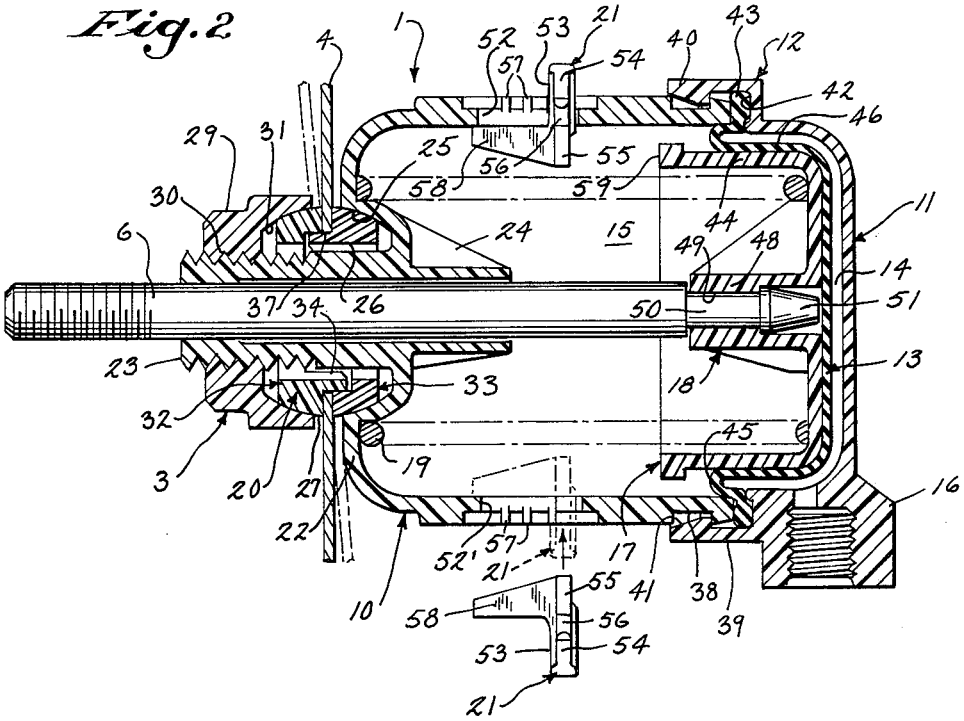
FIG. 2 is an enlarged axial section to the actuator shown in FIG. 1.

The illustrated actuator 1 is particularly constructed as a reliable, inexpensive assembly which can be discarded and replaced if it should malfunction. Referring particularly to FIG. 2, the illustrated embodiment of the actuator 1 generally includes a cylindrical body portion formed by a cup-shaped open-ended cylinder 10 which is closed by a shallow cup-shaped head 11. The head 11 is secured to the cylinder by a snap-joint connection 12 for rapid and convenient assembly. A diaphragm 13 has its periphery secured between the open end of the cylinder 10 and the head. The diaphragm 13 divides the body portion into a pair of piston positioning chambers 14 and 15. An input signal line connector 16 is provided in the head 11 and the fluid signal is established in the one chamber 14. A cup-shaped piston member 17 is located within the opposite chamber 15 in the cylinder and is secured by a snap-joint connection 18 to the inner end of the piston rod 6. A coil spring 19 acts between the base of the cylinder 10 and the piston 17 to load and urge the piston 17 to move outwardly, forcing the diaphragm 13 into the head 11. An input pressure signal of a selected minimum level will overcome the force of the coil spring 19 forcing the diaphragm 13 and the piston 17 to move from the head 11 and into the cylinder 10, thereby causing the outward movement or extension of the piston rod 6 for positioning of the damper 2. Similarly, reducing of the air pressure permits the spring 19 to expand and returns the piston 17 and diaphragm 13 to the retracted position into the head 11 as shown in FIG. 2, thereby reversing the positioning of the piston rod 6 and the damper 2.

In accordance with particularly significant and novel teaching of the present invention, the swivel mounting assembly 3 interconnects the actuator 1 to the housing wall 4 and permits limited swivel positioning for proper alignment of the piston rod for coupling to the damper. The mounting assembly 3 also allows 360° rotation or orientation of the actuator 1 for optimum positioning relative to the air signal line 9. As more fully developed hereinafter, the swivel mounting assembly 3 includes a releasably interconnected clamping unit 20 which is not employed or assembled with the unit where rigid mounting of the actuator 1 is desired.

In a further aspect of the preferred embodiment of the present invention, a plurality of simple snap-in stroke adjustment stop means 21 are secured to the cylinder 10 to limit the stroke of the piston 17 and thereby adjust the length of the working stroke for any given pressure range.

The snap-joint connection of the several components essentially eliminates the conventional separate fasteners during the assembly and mounting and thereby provides for a relatively inexpensive and rapid manufacture of actuator 1. The present invention thus is particularly directed to the provision of a reliable and relatively long-life pneumatic actuator which can be readily constructed as a throw-away unit for simplicity of service.

More particularly, the cup-shaped cylinder 10 is formed with an integral mounting base wall 22 with a piston rod hub 23 extending from within the cylinder 10 and outwardly of the wall 22. A plurality of strengthening braces 24 extends between the inner periphery of the hub 23 and the base 22 to provide a strong stable support for the piston rod 6 which is slidably mounted in the hub 23.

The swivel mount assembly 3 is coupled to the base wall 22 of the cylinder 10 as follows. The base wall 22 is formed with an annular depression or recess 25 encircling the hub 23. The side wall of the recess 25 is generally spherically shaped and defines a spherical chordal sector of a sphere. A chordal sector is defined as that portion of a sphere formed by parallel planes to one side of a center plane of the sphere. The annular swivel clamping member 20 includes an inner opening 26 somewhat larger than the diameter of the hub 23 and fits loosely over the hub 23 with the inner end projecting into the spherical recess 25. The exterior periphery 27 of the member 20 is generally spherical and defines a spherical central sector of a sphere with the same radius as that of the chordal sector. The member 20 in telescoping over the hub 23 moves partially into the recess 25 as illustrated more clearly in FIG. 2 to locate the mounting wall 4 in spaced relation to the cylinder base 22. The spherical center sector of member 20 is secured in position by a clamping nut 29 which threads onto the hub 23 as at 30. The nut 29 is formed with an inner spherical surface 31 similar to that of the chordal sector and correspondingly extends over the outer end of the spherical center sector periphery 27 to the exterior side of the mounting wall 4. The spherical center sector and the clamping nut are preferably formed of a suitable plastic which establishes a firm pressure mounting of the clamping member and therefore of the actuator with respect to the mounting wall. Although the pressure forces will maintain preset positioning of the actuator with respect to the mounting wall under normal operating conditions, the actuator can be swiveled relative to the mounting wall 4 as shown in phantom in FIG. 2. This permits essentially limited universal orienting of the actuator for very accurate mounting and positioning of the piston rod 6 relative to the interconnecting linkage 7 for coupling damper 2. It thus eliminates the necessity of special linkages and adjustments to accurately couple the piston rod 6 to the damper 2 and facilitates the mounting of the actuator 1.

Figure 4:
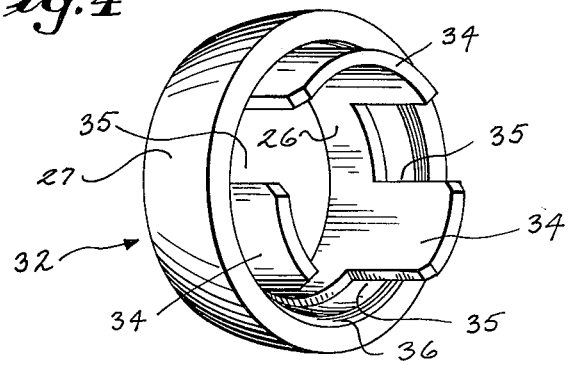
FIG. 4 is an enlarged pictorial view of an element of a clamping member shown in FIGS. 1-3.
Figures 3, 5, 6, 7:
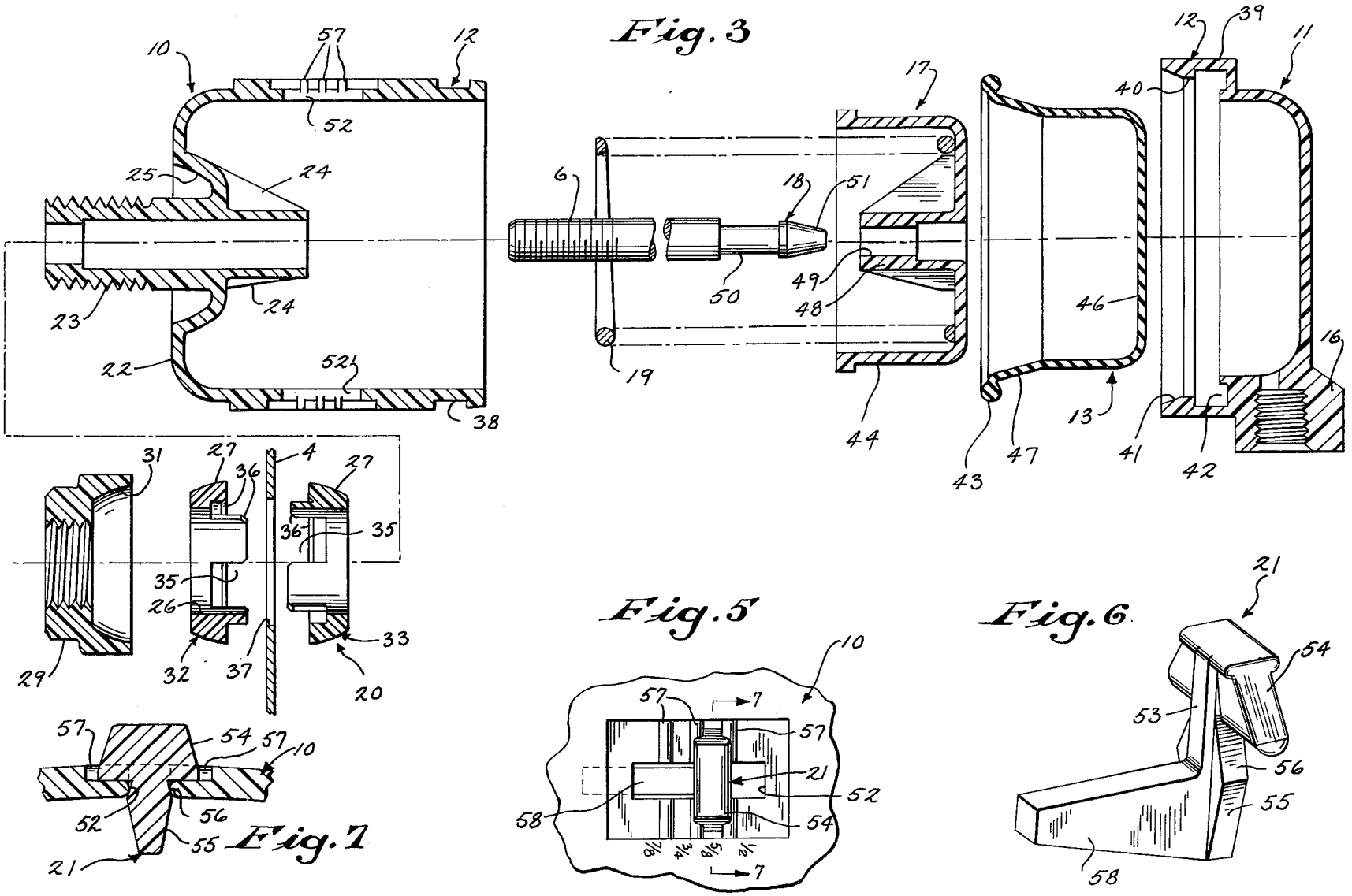
FIG. 3 is an exploded elevational view of the actuator.
FIG. 5 is a fragmentary view showing a stroke adjustment stop unit.
FIG. 6 is an enlarged pictorial view of the stop element.
FIG. 7 is a fragmentary view taken generally on line 7—7 of FIG. 5.

In a preferred construction as illustrated for the embodiment of the invention, the clamping member 27 is formed as a two-part unit including a pair of identical annular rings or washers 32 and 33 defined by a center plane through the spherical center sector, as most clearly shown in FIG. 3. The washers 32 and 33 snap together to clamp the wall 4 therebetween as shown in FIGS. 1, 2 and 3. Referring to member 32 as shown in FIGS. 3 and 4, a plurality of similar circumferentially spaced arms 34 project outwardly from the inner face or opening 26 of the member. The circumferential width of the fingers 34 are such that they are spaced by at least the width of the arms and form slots or recesses 35 therebetween. The washer 33 is similarly constructed and corresponding elements are defined by similar primed numbers for simplicity and clarity of explanation. In assembly, the members 32 and 33 are oriented with the arms 34 aligned with the recesses 35 of the opposite members. The members 32 and 33 are then snapped together with the arms 34 forming an interference fit with the recesses 35 of the opposing member. The edge of the recesses and the arms are chamfered as at 36 for convenience assembly of the members.

The mounting wall or surface 4 is provided with an opening 37 generally corresponding to that defined by the outer surface of the arms 34. In mounting of the actuator 1, washers 32 and 33 are located to the opposite side of the mounting surface 4 and snapped together to define an interconnection to the mounting surface 4 with the opening 37 adapted to receive the mounting hub 23 of the cylinder housing 10. The threaded hub 23 is passed through the snapped swivel members and the nut 29 is tightened with a suitable wrench or other implement, and the actuator 1 is fastened in place while remaining free for limited swivel movement without binding.

In a practical implementation, the sector members or rings 32 and 33 were injection molded from a polyactal-based uniformly oil-lubricated plastic resin manufactured and sold under the trademark "Oilon PV 80." The cylinder 10 and nut 29 were formed of an injection molded polycarbonate. The head 11 and piston 17 were similarly formed of a molded polycarbonate. This allows forming of the parts by injection molding without necessity of machining and special connectors.

More particularly, in the illustrated embodiment of the invention, the outer end of the cup-shaped cylinder 10 is closed by the head 11 with the snap-joint connection 12. The side of the cylinder 10 includes a rectangular recess 38 spaced inwardly slightly from the outermost end of the cylinder.

The cup-shaped head 11 has a coupling sidewall 39 which is adapted to telescope over the outer end of the cylinder 10. The inner surface of the head sidewall 39 is formed with a projection 40. The projection 40 has a diameter slightly less than the outer diameter of the cylinder 10 and is adapted to mate and lock within the recess 38 of the cylinder sidewall, as shown in FIG. 2. The sidewall 39 and end of cylinder 10 are formed with inclined surfaces 41. In assembly, the head 11 is adapted to be forced over the end of the cylinder 10, with the inclined surface 41 acting as a cam to slightly expand the head 11 until the projection moves into the recess 38. The sidewall 39 collapses into the recess 38 to firmly interlock the head to the cylinder body.

The end of cylinder 10 defines a planar outer surface against which the outer periphery of the diaphragm 13 is clamped by head 11. The head 11 includes an inner ledge portion 42 aligned with the outer planar end of the cylinder 10. In forcing the head 11 onto the cylinder 10, the diaphragm 13 is compressed therebetween to firmly and physically interconnect the diaphragm in place and to form a fluid tight seal.

In the illustrated embodiment of the invention, a rolling diaphragm construction is employed. Thus, the diaphragm is generally a hat-shaped member as most clearly shown in FIG. 3. The diaphragm 13 has an annular, narrow bead 43 on the open end of the member. The bead 43 is compressed between the cylinder and head and establishes a fluid-tight joint. Piston 17 is a cup-shaped member having a sidewall 44 of a diameter less than the cylinder 10 to form an annular space therebetween. The diaphragm 13 is folded over the piston 17 with a rolling convolution 45 between the piston 17 and cylinder 10 to define a rolling diaphragm construction.

The unsupported area of diaphragm 13 is the convolution 45 which assumes a true semi-conductor shape which is the natural configuration of a pressure filled elastic membrane. By maintaining such a semi-conductor shape, the effective area is essentially constant over the working stroke of the piston 17. This produces a linear characteristic of the pneumatic pressure signal versus the stroke of piston position.

The diaphragm 13 has very low hysteresis and responds to small changes in pressures. The rolling action with the plastic parts produces very low moving friction for optimum response of the actuator.

As shown in FIG. 3, the diaphragm 13 includes an outer, generally cylindrical base portion 46 with a slight tapered portion 47 to the end clamping bead 43. The cylindrical cup-shaped piston 17 projects into the diaphragm 13 with the tapered portion forming the convolution 45.

The piston 17 is formed of a suitable injection mold plastic such as a polycarbonate and includes an integral coupling tube 48 connected to the shaft 6 by the snap joint connection 18. The tube 48 is formed with a stepped internal diameter defining an inner projection 49 adjacent to the shaft receiving end and with an outer enlarged opening. The inner end of piston rod 6 is formed with a stepped end portion defining a recess 50 adapted to mate and interlock with the projection 49. The end 51 of the rod 6 is located within the enlarged opening of the tube 48. The end 51 is also formed with a generally cone-shaped configuration to define an inclined camming surface. In assembly the rod 6 is forced into the coupling tube 48 which expands sufficiently to allow the entrance of the rod until the recess 50 is aligned with the enlargement 49. The tube members then snap together to form a firm mechanical snap-joint connection. This provides a very simple, reliable and inexpensive construction and method of assembly, further contributing to the practical throw-away construction.

In accordance with a further aspect of the illustrated embodiment of the invention, the stroke adjustment or stop means 21 includes a pair of similarly constructed stop units formed to the opposite sides of the cylinder 10. As the units 21 are identically constructed, one unit 21 will be described in detail, with the corresponding elements of the other unit identified by corresponding primed numbers.

The stop unit 21 includes a generally L-shaped stop 21 which is adjustably secured within a graduated slot or opening 52 integrally molded in the side of the cylinder 10. The L-shaped stop 21 includes a generally T-shaped mounting leg 53 as shown in FIGS. 6 and 7, with the stem extending through the slot 52 and with an outer cross-bar 54 extending to the opposite side of the slot 52. The cross bar 54 is a generally plate-like member with reduced side portions which abut the outer face of the cylinder 10. The slot and the mounting leg are designed to establish an interference fit permitting manual insertion and removal of the stop member while establishing a relatively stable mounting as follows.

The sidewall opening 52 is preferably formed with a slight chamfer and the inner end of the stem 53 is tapered as at 55 to form an inner cam portion. This permits convenient manual introduction of the stop member into the slot 52 with the necessary interference fit to locate and hold the stop within the slot.

The inner cam portion 55 extends outwardly toward the cross bar 54 and terminates in slightly spaced relation thereto in a width slightly greater than the width of the slot 52. A reverse tapered locking portion 56 continues along the stem 53 to the cross-bar 54. Thus, in the assembly, upon insertion of the mounting leg, the tapered cam portion 55 facilitates the manual introduction of the mounting leg with the cam portion moving through the slot and aligning the interlocking portion 56 with the sidewalls or edges of the slot 52, thereby providing an interference releasable locking of the stop member within the opening, as shown in FIG. 7.

In addition, the cylinder 10 is formed with a plurality of recesses defining locating ledges 57 to the opposite sides of the slot 52 which cooperate with the cross-bar 54 to identify the particular stroke length. For example, in the illustrated embodiment of the invention, three ledges 57 are illustrated permitting the placement of the stop member for different locations including the location to the opposite ends of the ledges and between the three ledges.

The L-shaped stop 21 includes a locking leg 58 which is somewhat longer than the length of the slot 52 such that the outer end of the leg 58 extends beyond the leg 58, which is common with the upper surface of the mounting leg 53, shown slightly offset to permit convenient insertion of the L-shaped stop and to form a planar ledge aligned with the bottom edge 59 of the piston sidewall.

The L-shaped stop 21 is introduced by tilting or pivoting of the stop leg 58 to move into the slot 52 and then pivoting of the member to locate the mounting leg 53 in interference fit within the slot 52, and with the locking leg extending lognitudinally of the cylinder 10. For removal, it is merely necessary to grip the exterior portion 54 of the mounting leg 53 and pull outwardly thereon, pivoting slightly to permit the withdrawal of the stop leg through the slot.

The stops may be formed of a suitable molded plastic such as a nylon material.

In operation, the air pressure signal is applied to the input chamber 14 formed between the diaphragm 13 and the head 11. At a selected pressure level, the piston 17 and interconnected piston rod 6 are moved outwardly. The diaphragm 13 rolls off of the piston sidewall 44 and onto the interior of cylinder 10. The piston 17 moves outwardly with increasing pressure until the piston end 59 engages the inward projecting stop units 21 in accordance with the desired maximum working stroke of the actuator 1. If the signal pressure decreases, the compressed spring 19 acts to return the piston 17 and diaphragm 13, which rolls off the wall of the cylinder 10 and returns to the sidewall 44 of the piston 17. As previously noted, the rolling diaphragm which maintains an essentially constant cross-sectional operating effective area produces a very linear characteristic of stroke versus controlled pressure.

The illustrated embodiment of the present invention provides a particularly satisfactory type of throw-away plastic actuator as all of the several components may be conveniently formed by inexpensive plastic molding. Further, with the several snap-joint connections the components can be rapidly assembled while maintaining a high degree of reliability.

The swivel mounting permitted by the present invention particularly provides a highly versatile basic model which can be readily applied over a wide application range.

As previously noted, although the swivel mounting is permitted, the invention is readily adapted to a rigid mounting. For example, if the swivel mounting member 20 is removed and the mounting surface 4 provided with an opening essentially corresponding to the diameter of the hub, base 22 of cylinder 10 may be firmly clamped to wall 4 by tightening of the clamping nut 29 onto the hub 23 to firmly and rigidly attach the actuator to the mounting surface. As in the previous embodiment employing the swivel mounting arrangement, the actuator can be rotated through 360° for optimum location of the air connection to the incoming hose.

The present invention thus provides a simple, reliable, relatively inexpensive pneumatic fluid actuator and, particularly, a pneumatic actuator for mass production. The invention, as illustrated, is particularly adapted to mass production of pneumatic actuators for supplying of various, original equipment manufacturers for different uses. The actuator is particularly adapted to use in the heating, ventilating and air conditioning field.

Various modes of carrying out the invention are contemplated as being within the scope of the following claims, particularly pointing out and distinctly claiming the subject matter which is regarded as the invention.

I claim:

1. In a fluid power actuator, an outer body portion having a mounting wall with an opening, an operator projecting through said mounting wall opening, a fluid driven member in said body portion and connected to said operator, said mounting wall further including an annular recess encircling said opening, said recess defining a spherical chordal section having a spherically shaped sidewall with an outer circular opening to the recess of a diameter less than the diameter of a sphere generated by the full development of the spherically shaped sidewall, an annular mounting means clamped within said recess and having a central opening for the operator and an outer periphery defining a central sector of said sphere, said central opening having a diameter greater than the operator and being spaced from said operator and permitting movement of the mounting means independently of the body portion and the operator, a clamping means secured to said body portion in spaced relation to said mounting wall, said clamping means having a spherical chordal sector generally corresponding to and coaxially aligned with said spherical chordal sector defined by said recess and operable to firmly clamp the mounting means in position for supporting of the actuator, wherein said annular mounting means is a two-piece member having a pair of similar ring members with internal slot and projections defining a snap-joint connection of the ring members.

2. In the fluid actuator of claim 1 wherein said fluid driven member is a piston means slidably mounted within said body portion, said piston means dividing the body portion into a pair of opposite piston-positioning chambers, at least one of said chambers having an input signal means for receiving of a fluid signal for positioning of said piston means, said operator is a piston rod slidably mounted within the mounting wall opening, said mounting wall having an operator hub including said opening, and said clamping means being releasably secured to said hub.

3. In the actuator of claim 2 wherein said piston means includes a central hub portion, said piston rod projecting into said hub portion, said hub portion and said piston rod having complementing slots and projection means defining a snap-joint connection of the rod to the hub portion.

4. The actuator of claim 1, wherein said body portion includes a cup-shaped cylindrical body member having said mounting wall integrally formed to define the base portion of said member, a cup-shaped head member having an annular sidewall adapted to telescope with the outer end of said cylindrical body member, the opposing telescoped surfaces of said cylindrical body member and said cup-shaped head member including complementing parts of a snapjoint connector.

5. The actuator of claim 4 wherein said connector includes an annular slot and a mating projection, said telescoping members having inclined camming surface means to facilitate the telescoping movement of the members to align said snap connecting slot and projection.

6. In a fluid power actuator, an outer body portion having a mounting wall with an opening, an operator projecting through said mounting wall opening, a fluid driven member in said body portion and connected to said operator, said mounting wall further including an annular recess encircling said opening, said recess defining a spherical chordal section having a spherically shaped sidewall with an outer circular opening to the recess of a diameter less than the diameter of a sphere generated by the full development of the spherically shaped sidewall, an annular mounting means clamped within said recess and having a central opening for the operator and an outer periphery defining a central sector of said sphere, said central opening having a diameter greater than the operator and being spaced from said operator and permitting movement of the mounting means indepedently of the body portion and the operator, a clamping means secured to said body portion in spaced relation to said mounting wall, said clamping means having a spherical chordal sector generally corresponding to and coaxially aligned with said spherical chordal sector defined by said recess and operable to firmly clamp the mounting means in position for supporting of the actuator, said body portion includes a tubular housing, said driven member being a piston member, a plurality of similar circumferentially distributed stop means, each of said stop means including a longitudinally extended slot in the sidewall of the member, a generally L-shaped stop member having a mounting leg and a stop leg of a length greater than the length of the slot, said stop member being located in said slot with the mounting leg extending generally radially of the housing and secured within said slot by a snap-joint means, each slot including a plurality of snap-joint means, said stop leg extending generally axially of the housing and said stop leg being longer than said slot whereby in all positions of said stop member the outer end of the stop leg overlaps the edge in the slot to hold the stop member in position in the path of said fluid driven member.

7. The actuator of claim 6 wherein said mounting leg includes an outer locating portion engaging the exterior wall of the body portion and an inner tapered cam portion terminating in spaced relation to the outer locating portion, and a latching offset portion between said cam portion and said outer locating portion.

8. In a pneumatic piston actuator having a piston member slidably mounted within a tubular member, a diaphragm overlying said piston member and dividing the tubular member into a pair of opposite piston-positioning chambers, at least on of said chambers having an input signal means for receiving of a pneumatic signal for positioning of the diaphragm and piston member, a piston rod secured to the piston member, said tubular member having a mounting wall with a mounting hub projecting outwardly of the wall, said mounting wall further including an annular recess encircling said hub, said recess defining a spherical chordal sector, a clamping member having means for releasably securing said clamping member on said hub in spaced relation to said mounting wall to define a clamping gap therebetween, said clamping member having a recess defining a spherical chordal sector generally corresponding to the spherical chordal sector of said recess, and a multiple part swivel member having an outer surface complementing said recesses and fixedly clamped within said recesses by said clamping member on said hub and having separable interconnecting means and operable for clamping a mounting wall therebetween.

9. The actuator of claim 8 wherein said swivel member is a ring having an outer spherically shaped surface, said ring including a pair of similar annular half-ring members each of which includes a plurality of circumferentially spaced resilient arms projecting axially into the opposite half-ring member, each of said rings having recesses between said arms with a slightly smaller diametrical spacing to establish an interference fit with said arms.

10. The actuator of claim 9 wherein said recesses and arms having chamfered edges to facilitate assembly of the half-ring members.

11. The actuator of claim 8 wherein said tubular member includes a cup-shaped cylindrical body having said mounting wall integrally formed to define the base portion of said body, a shallow cup-shaped head member having an outer sidewall adapted to telescope over the outer end wall of said cylindrical body member, the exterior surface of said cylindrical body member and the inner surface of said sidewall including a complementing recess and projection defining a connector, said telescoped walls having inclined camming surfaces to facilitate the telescoping movement of the members to align said snap connecting recess and projection.

12. In the actuator of claim 11, wherein said tubular member includes a plurality of similar circumferentially distributed stop means, each of said stop means including a longitudinally extended slot in the side wall of the member, a generally L-shaped stop member having a mounting leg and a depending stop leg, said stop member being located into said opening with the mounting leg extending generally radially and the stop leg extending generally axially of the tubular member, said stop leg being longer than said opening whereby in all positions of said stop member the outer end of the stop leg is extended beyond the edge of the opening, said mounting leg including being generally T-shaped with an outer locating cross-bar portion and a stem having an inner tapered cam portion terminating in spaced relation into the outer cross-bar portion with an inset latching portion included between said cam portion and said cross-bar in an interference fit with the edges of the opening.

13. The pneumatic actuator of claim 12 wherein said tubular member is a cup-shaped cylinder having an integral mounting wall, a shallow cup-shaped head member having an outer sidewall adapted to telescope over the outer end wall of said cylindrical body member, the exterior surface of said cylindrical body member and the inner surface of said sidewall including a complementing recess and projection, defining a connector, said telescoped walls having inclined camming surfaces to facilitate the telescoping movement of the members to align said snap connecting recess and projection.

14. The actuator of claim 13 wherein said swivel member is a ring having an outer spherically shaped surface, said ring including a pair of similar annular half-ring members each of which includes a plurality of circumferentially spaced resilient arms projecting axially into the opposite half-ring member, each of said rings having recesses between said arms with a slightly smaller diametrical spacing to establish an interference fit with said arms.

15. The actuator of claim 14 wherein said diaphragm is clamped between the cylinder and head, said diaphragm including a convolution location between the piston and the cylinder to define a rolling diaphragm construction.

16. In combination, a load device having a housing with a mounting opening in said housing, a fluid power actuator having a body portion with an integral actuator mounting wall adjacent said mounting opening, an integral hub member projecting from said mounting wall through said opening, an operator slidably journaled in said integral hub member, a fluid driven member in said body portion and connected to said operator, said mounting wall further including an annular recess encircling said opening, said recess defining a spherical chordal sector having a spherically shaped sidewall with an outer circular opening to the recess of a diameter less than the diameter of a sphere generated by the full development of the spherically shaped sidewall, said actuator being located with the mounting wall adjacent said housing and said hub projecting through said opening in said housing, an annular two piece mounting member having a pair of similar ring members with internal slot and projections defining a snap-joint connection of the ring members for clamping within said mounting opening, said ring members having an outer periphery defining a central sector of the sphere including said spherical chordal sector, and clamping means including a nut member with a spherical chordal sector generally corresponding to and coaxially aligned with said spherical chordal sector defined by said annular recess in said body portion to firmly clamp the body portion to the ring members for swivel mounting.

17. In combination, a load device having a housing with a mounting opening in said housing, a fluid power actuator having a body portion with an integral actuator mounting wall adjacent said mounting opening, an integral hub member projecting from said mounting wall through said opening, an operator slidably journaled in said integral hub member, a fluid driven member in said body portion and connected to said operator, said mounting wall further including an annular recess encircling said opening, said recess defining a spherical chordal sector having a spherically shaped sidewall with an outer circular opening to the recess of a diameter less than the diameter of a sphere generated by the full development of the spherically shaped sidewall, said actuator being located with the mounting wall adjacent said housing and said hub projecting through said opening in said housing, said hub being threaded, a threaded nut for releasable attachment to said hub with a tight fit between the threads of the hub and nut to firmly hold the nut on the hub for clamping of said actuator to said housing, a mounting member having a central opening for said operator and an outer periphery defining a central sector of the sphere, said mounting member being located over said hub, said nut includes a spherical chordal sector generally corresponding to and coaxially aligned with said spherical chordal sector defined by said annular recess in said body portion for clamping of the mounting member within the annular recesses in said nut and said mounting wall.

18. A pneumatic piston-diaphragm actuator comprising a cylinder having an end mounting wall, said base wall including an outwardly axially extending mounting hub with the outer end exteriorly threaded, a cup-shaped piston reciprocally mounted within said cylinder and having a coaxial hub, a piston rod extended into said hub and connected to the hub by an annular snap-joint, a coil spring encircling the piston rod within said cylinder and acting between the inner base wall of the cylinder and the base of the cup-shaped piston, a diaphragm overlying said piston and having an outer peripheral portion abutting the outer edge of the cylinder, a cup-shaped head telescoped over the cylinder and a cup-shaped head having a flange telescoped over the outer wall of the cylinder and connected thereto by a snap-joint, said head including an inner clamping ledge abutting the outer wall of the diaphragm and clamping the diaphragm between the cylinder and the head with a fluid-type joint, said diaphragm being a generally cup-shaped member having the sidewall formed into the shape of a convolution extending between the wall of the piston and the interior wall of the cylinder whereby said diaphragm rolls between the walls of the cylinder and the sidewall of the piston as said piston moves axially of the cylinder, the sidewalls of said cylinder including a pair of diametrically located stop slots extending longitudinally of the cylinder, a pair of L-shaped stop members located one within each of said slots, each of said L-shaped stop members including a mounting leg extending through the slot with an outer cross-bar abutting the outer surface of the cylinder, the stem of the leg including an inner tapered portion defining a camming member having an innermost end smaller than said slot and laterally enlarged to a recessed latching portion, said latching portion tapering inwardly to the outer stop portion whereby said member is lodged with the locking portion aligned with the cylinder wall to define an interference fit, each of said stops including a depending stop leg, said leg being longer than the slot whereby the outer end of the leg is located beneath the outermost edge of the slot in the assembled relation, a plurality of ledge members on the outer wall of the cylinder located in longitudinally spaced relation along the side of the slot, said cross-bar being located in adjacent relation to one of said ledges to hold the stop member in any one of a plurality of positions defined by said ledges, and said head having a fluid connector for interconnection to an incoming pneumatic signal line.

* * * * *

UNITED STATES PATENT AND TRADEMARK OFFICE

CERTIFICATE OF CORRECTION

PATENT NO. : 4,056,043

DATED : November 1, 1977

INVENTOR(S) : DURVASULA V. SRIRAMAMURTY ET AL

It is certified that error appears in the above-identified patent and that said Letters Patent are hereby corrected as shown below:

| | | | | |
|---|---|---|---|---|
| Column | [57], | Line | 1, | after "a" cancel "cup-shape" and insert --- cup-shaped ---; |
| Column | 1, | Line | 34, | before "a" cancel "ployers" and insert --- ploys ---; |
| Column | 2, | Line | 62, | before "shaped" cancel "sperically" and insert --- spherically ---; |
| Column | 6, | Line | 23, | after "for" cancel "convenience" and insert --- convenient ---; |
| Column | 7, | Line | 20, | before "shape" cancel "semi-conductor" and insert --- semi-circular ---; |
| Column | 7, | Line | 22, | after "a" cancel "semi-conductor" and insert --- semi-circular ---; |
| Column | 7, | Line | 23, | before "shape" cancel "tor"; |
| Column | 8, | Line | 50, | after "extending" cancel "lognitudinally" and insert --- longitudinally ---; |

UNITED STATES PATENT AND TRADEMARK OFFICE

CERTIFICATE OF CORRECTION

PATENT NO. : 4,056,043

DATED : November 1, 1977

INVENTOR(S) : DURVASULA V. SRIRAMAMURTY ET AL

It is certified that error appears in the above-identified patent and that said Letters Patent are hereby corrected as shown below:

---continued ---

| | | | | |
|---|---|---|---|---|
| Column CLAIM 4 | 10, | Line | 26, | after "a" cancel "snapjoint" and insert --- snap-joint ---; |
| Column CLAIM 8 | 11, | Line | 15, | after "least" cancel "on" and insert --- one ---; |

Signed and Sealed this

Second Day of May 1978

[SEAL]

Attest:

RUTH C. MASON
Attesting Officer

LUTRELLE F. PARKER
Acting Commissioner of Patents and Trademarks